US006565707B2

(12) United States Patent
Behnke et al.

(10) Patent No.: US 6,565,707 B2
(45) **Date of Patent: *May 20, 2003**

(54) SOFT AND TOUGH PAPER PRODUCT WITH HIGH BULK

(75) Inventors: Janica S. Behnke, Appleton, WI (US); Kenneth C. Larson, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/104,638

(22) Filed: Mar. 22, 2002

(65) Prior Publication Data

US 2002/0134520 A1 Sep. 26, 2002

Related U.S. Application Data

(63) Continuation of application No. 09/451,602, filed on Nov. 30, 1999, now Pat. No. 6,423,180.
(60) Provisional application No. 60/114,364, filed on Dec. 30, 1998.

(51) Int. Cl.[7] ..... B31F 1/12
(52) U.S. Cl. ..... 162/112
(58) Field of Search ..... 162/109, 111–113, 162/123, 125, 129, 127, 130, 158, 164.1, 164.3, 164.6, 168.1, 183

(56) References Cited

U.S. PATENT DOCUMENTS 3,879,257 A 4/1975 Gentile et al.
3,903,342 A 9/1975 Roberts, Jr.
4,000,237 A 12/1976 Roberts, Jr.
4,420,368 A 12/1983 Drach
5,015,245 A 5/1991 Noda
5,048,589 A 9/1991 Cook et al.
5,087,324 A * 2/1992 Awofeso et al. ..... 162/111
5,200,037 A 4/1993 Noda
5,264,082 A 11/1993 Phan et al.
5,348,620 A 9/1994 Hermans et al.
5,399,412 A * 3/1995 Sudall et al. ..... 428/153
5,429,686 A 7/1995 Chiu et al.
5,501,768 A 3/1996 Hermans et al.
5,562,805 A 10/1996 Kamps et al.
5,591,309 A 1/1997 Rugowski et al.
5,593,545 A 1/1997 Rugowski et al.
5,616,207 A 4/1997 Sudall et al.
5,667,636 A 9/1997 Engel et al.
5,702,571 A * 12/1997 Kamps et al. ..... 162/117
5,746,887 A 5/1998 Wendt et al.
5,776,306 A 7/1998 Hepford
6,033,523 A * 3/2000 Dwiggins et al. ..... 162/111
6,033,761 A * 3/2000 Dwiggins et al. ..... 428/172
6,153,053 A * 11/2000 Harper et al. ..... 162/109
6,423,180 B1 7/2002 Behnke et al.

* cited by examiner

*Primary Examiner*—Peter Chin
*Assistant Examiner*—K. Wanzer
(74) *Attorney, Agent, or Firm*—Gregory E. Croft

(57) ABSTRACT

The present invention is directed to a paper product which is very flexible, tough when wet, and has a high bulk. In particular, the paper towel has a dry, specific modulus less than 0.0040 kilograms, a bulk greater than 10 cubic centimeters per gram and a wet strength ratio greater than 0.40.

18 Claims, 2 Drawing Sheets

SOFT AND TOUGH PAPER PRODUCT WITH HIGH BULK

This application is a continuation application of U.S. Ser. No. 09/451,502 entitled "Soft And Tough Paper Product With High Bulk" filed Nov. 30, 1999, now U.S. Pat. No. 6,423,180, which claims priority from U.S. Serial No. 60/114,364 entitled "Soft And Tough Paper Product With High Bulk" filed Dec. 30, 1998. The entirety of Ser. Nos. 09/451,602 and 60/114,364 is hereby incorporated by reference.

FIELD OF THE INVENTION

The present invention is directed to a soft, absorbent and strong paper product, and more particularly, to a high bulk, low dry modulus and high wet strength ratio paper product.

BACKGROUND OF THE INVENTION

In the manufacture of a number of paper products, such as tissues, towels, napkins, wipers and the like, a wide variety of product characteristics must be given attention in order to provide a final product with the appropriate blend of attributes suitable for the product's intended purposes. Among these various attributes, improving softness, strength, absorbency, bulk and stretch have always been major objectives, particularly for products in the consumer markets. Generally, disposable paper products rely on superior performance in softness, absorbency and strength. In particular, the consumer desires a paper product that is moldable as a cleaning instrument, absorbs large spills and does not tear when wet. In addition, the manufacturer desires a firm paper product that has a low roll weight and a large diameter.

Softness is generally how the paper product feels to the user on his or her face or hand. Softness generally depends on various physical properties, including the surface feel and stiffness of the product. The stiffness, in turn, generally depends on the strength of the product. The strength of the paper product is the product's ability to maintain its physical integrity and to resist tearing or shredding under use conditions, particularly when wet. Strength is a combination of tensile strength and stretch. When one is higher, the other can be lower and still maintain "strength." Also, when a certain level of wet strength is needed, using a binder that provides a higher ratio of wet/dry strength allows dry strength to be lower and, therefore, softness to be higher.

Traditionally, many paper products have been made using a wet-pressing process in which a significant amount of water is removed from a wet-laid web by pressing or squeezing water from the web prior to final drying. In particular, while supported by an absorbent papermaking felt, the web is squeezed between the felt and the surface of a rotating heated cylinder, such as a Yankee dryer, using a pressure roll as the web is transferred to the surface of the Yankee dryer. The dried web is then dislodged from the Yankee dryer with a doctor blade, which is known as creping. Creping serves to partially debond the dried web by breaking many of the bonds previously formed during the web-pressing stages of the process. The web may be creped dry or wet. Creping can greatly improve the feel of the web, but at the expense of a significant loss in strength.

A creping method to make both a strong and soft towel is disclosed in U.S. Pat. No. 3,879,257, issued to Gentile et al. and assigned to the Scott Paper Company (1975), entitled "Absorbent Unitary Laminate-Like Fibrous Webs and Method for Producing Them," herein incorporated by reference. The Gentile et al. patent discloses a process of creping a base sheet, then printing a binder on one side of the base sheet, creping the base sheet again, then printing a binder on the other side of the base sheet, and then creping the base sheet a third time. In particular, the base sheet is printed while traveling through gravure nip rolls. During the gravure print process referred to as the Double ReCrepe (DRC) process, the gravure print process compresses the base sheet to less than 50% of its incoming caliper as it prints the binder onto the sheet. The DRC process provides a web possessing a good combination of strength and softness, but the process of having, successively, three pressings does not provide a particularly bulky sheet. Also, a process that includes three crepes is much more complicated than a process of having one crepe.

More recently, through-drying has become an alternate means of drying paper webs. Through-drying provides a relatively noncompressive method of removing water from the web by passing hot air through the web until it is dry. More specifically, a wet-laid web is transferred from a forming fabric to a coarse, highly permeable throughdrying fabric and retained on the throughdrying fabric until fairly dry. The resulting through-dried web is bulkier than a conventionally dried creped sheet because the web is less compressed. Squeezing water from the wet web is eliminated, although the use of a pressure roll to subsequently transfer the web to a Yankee dryer for creping may still be used.

While there is a processing incentive to eliminate the Yankee dryer and make an uncreped throughdried product, uncreped throughdried sheets are typically stiff and rough to the touch, if not calendared or layered, compared to their creped counterparts. This is partially due to the inherently high stiffness and strength of an uncreped sheet, but can also in part be due to the coarseness of the throughdrying fabric onto which the wet web is conformed and dried.

Accordingly, there is a need for a paper towel product, or paper sheet, that is soft, absorbent and strong, and more particularly, which has higher bulk, lower dry specific modulus and higher wet strength ratio values than those products made conventionally using a uncreped through-dried process or a double recreped process.

SUMMARY OF THE INVENTION

One aspect of the invention provides a strong, soft, bulky and absorbent disposable paper product, or paper sheet, having a dry, specific modulus less than about 0.0040 kilograms/grams per 3 inches, a bulk of greater than about 10 $cm^3/g$ and a wet strength ratio of greater than 0.40. Preferably, the specific modulus of the strong, soft and absorbent disposable paper product, or paper sheet, is less than 0.0038. More preferably, the specific modulus is less than 0.0034. Preferably, the bulk of the product or paper sheet is greater than 11. More preferably, the bulk is greater than 12. Preferably, the wet strength ratio of the product or paper sheet is greater than 0.5. More preferably, the wet strength ratio is greater than 0.6. This product or paper sheet also tends to have more dry and wet stretch than most previous products and paper sheets.

In one embodiment, the paper product is manufactured by first producing an uncreped through-air dried base sheet, then printing binder onto one side of the base sheet, then creping that side of the base sheet, and then printing and creping, successively, the other side of the base sheet.

These and other objects, advantages, and features of the present invention will be better understood upon review of the following detailed description of the preferred embodiments.

DETAILED DESCRIPTION OF THE INVENTION

Figure 1:
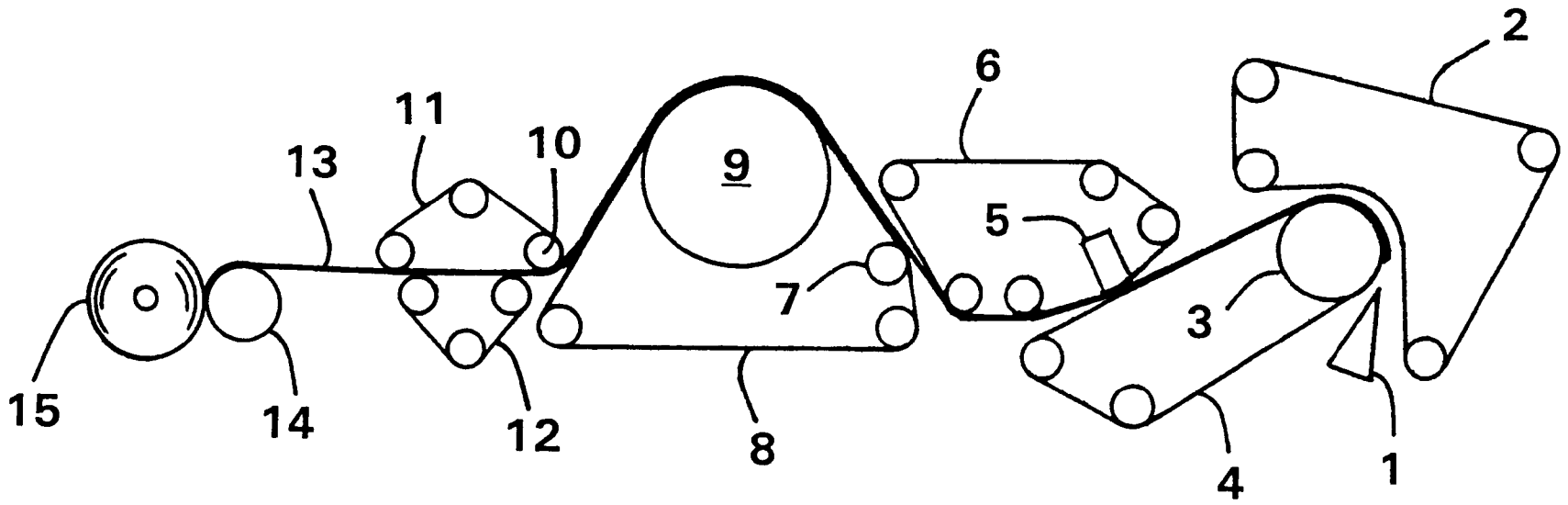
FIG. 1 is a schematic depiction of a method of making an uncreped throughdried base sheet as would be done in preparation for later printing and creping of the base sheet.

The present invention is directed to a paper tissue, napkin, wiper or towel product which has a low dry, specific modulus, high bulk and high wet strength ratio. In particular, the strong, soft and absorbent disposable paper product has a dry, specific modulus less than about 0.0040 kilograms/grams per 3 inches, a bulk of greater than about 10 cubic centimeters per gram ($cm^3/g$), a CD stretch greater than about 15%, and a wet strength ratio of greater than about 0.40. Preferably, the dry, specific modulus of the strong, soft and absorbent disposable paper product is less than about 0.0038 kilograms/grams per 3 inches. More preferably, the dry, specific modulus of the product is less than about 0.0034 kilograms/grams per 3 inches. Preferably, the bulk of the product is greater than about 11 $cm^3/g$. More preferably, the bulk is greater than about 12 $cm^3/g$. Preferably, the wet strength ratio of the product is greater than about 0.5. More preferably, the wet strength ratio is greater than about 0.6.

Tests

There are three properties to be tested of a paper product of the present invention: specific modulus, bulk and wet strength ratio.

Specific Modulus

The dry, specific modulus of the product is determined by dividing the geometric mean modulus of the product (in kilograms) by the geometric mean tensile (in grams of force per 3 inches) (7.62 centimeters) of the product. As used herein, tensile strengths are reported in kilograms of force per 3 inches (7.62 centimeters) of sample width, but may be expressed simply as "kilograms" for convenience.

To determine the dry, specific modulus of a product, a tensile tester is utilized, such as Sintech Tensile Tester, manufactured by Sintech Inc., Research Triangle Park, N.C. 27709. In particular, under TAPPI test conditions, a sample of the paper product is placed into the jaws of the tensile tester. The jaws are generally a pair of rectangular pieces which suspend the sample between the two pieces. The sample must be large enough to fit between the span of the jaws. Typically, the sample is about 3 inches wide and at least 4 inches long, as the span of the jaws of the Sintech Tensile Tester is 4 inches. After the sample is placed into the jaws, one piece of the jaw moves outward and the second piece is stationary. The piece of the jaw that moves has a strain gauge attached to it, which measures the strain placed on the towel sample. In addition, the tester enters a rate into the Sintech Tensile Tester. Generally, the standard rate is 10 inches per minute.

The paper product is tested in both directions in which it was produced, i.e., the machine direction, and the direction perpendicular to that in which it was produced, i.e., the cross direction. At least two samples must be tested—one for the machine direction and one for the cross direction. Generally, at least five to ten samples are tested in both directions and an average is taken of all the sample values.

The Sintech Tensile Tester produces a stress-strain curve for each sample. The stress is on the y-axis, while the strain is on the x-axis. As stated above, the specific modulus is determined by dividing the geometric mean modulus of the product by the geometric mean tensile strength of the product, as shown by the following formula:

$$\text{Dry Specific Modulus}=GM^{modulus}/GM^{tensile}$$

where $GM^{modulus}$ is the geometric mean modulus (determined by the slope of the stress-strain curve), and where $GM^{tensile}$ is the geometric mean tensile strength.

The geometric mean modulus is determined from the cross direction (CD) and machine direction (MD) stress-strain curves of the product by determining the least square line fit slope between the load points of 70 and 157 grams, using the following formula:

$$GM^{modulus} = \frac{(\text{change in load (kilograms)})(\text{corrected gauge length (mm.)})}{(\text{change in crosshead position (mm)})}$$

where the corrected gauge length=gauge length plus slack, and the slack is equal to the distance in millimeters of zero tension load when the specimen is in the tensile tester grips.

The geometric mean tensile strength of the product is determined by first multiplying the cross direction tensile strength by the machine direction tensile strength, and second taking the square root of that product, which can also be expressed in the following equation:

$$GM^{tensile}=\sqrt{CD^{tensile}*MD^{tensile}}$$

where

CD tensile is the average cross direction tensile strength, and where MD tensile is the average machine direction tensile strength.

Wet Strength Ratio

The wet strength ratio is determined by dividing the cross direction wet tensile strength by the cross direction dry tensile strength, as expressed by the following equation:

$$\text{Wet strength ratio}=CD^{wet}/CD^{dry}$$

where $CD^{wet}$ is the average cross direction wet tensile strength, and where $CD^{dry}$ is the average cross direction dry tensile strength.

Both the cross direction wet tensile strength and the cross direction dry tensile strength are measured in the units of grams per 3 inches. In particular, the cross direction dry tensile strength is determined utilizing the Sintech Tensile Tester, as described above. The cross direction wet tensile strength is determined in the same manner, except that the sample is first wetted in the center of the sample before any testing is performed. In particular, the cross direction wet tensile strength is determined by forming a loop of the specimen and wetting it with distilled water, then inserting into the tester grips of the Sintech Tensile Tester.

Bulk

The bulk is defined as the dry caliper of one sheet of the product divided by its basis weight. The bulk is measured in dimensions of centimeters cubed divided by grams ($cm^3/g$). The dry caliper is the thickness of a dry product measured under a controlled load. The bulk is determined in the following manner. Generally, an instrument, such as the EMVECO Model 200-A caliper tester from Emveco Co., is utilized. In particular, ten towel or tissue sheets about 4 inches in length by about 4 inches in width are stacked together. Once the sheets are stacked together, they are then subjected to pressure. In particular, a platen, which is a circular piece of metal which is 2.21 inches in diameter, presses down upon the stack of sheets. The pressure exerted by the platen is generally about 2 kilo Pascals (0.29 psi). Once the platen presses down upon the stack, the caliper of the stack is measured. The platen then lifts back up automatically. To determine the caliper for one sheet, the caliper for the entire stack is divided by 10, the number of sheets in the stack. The basis weight is determined after conditioning the sample in TAPPI-specified temperature and humidity conditions. Its units are 16./2880 square feet.

Products, Components Thereof and Process for Making

Suitable cellulosic fibers for use in connection with this invention include predominately softwood virgin papermaking fibers. Non-cellulosic synthetic fibers, chemithermo-mechanical fibers, hardwood fibers or recycled fibers can also be included as a portion. These sheets can be plied together to form a multi-ply product having two, three or more plies. These multi-ply products have unexpectedly high caliper and absorbency characteristics for the amount of fiber involved. The basis weight of the multi-ply products of this invention depends upon the number of plies and the basis weight of each ply. Additionally, the individual plies can be layered or blended (homogenous) with respect to the various fiber components.

Preferably, the towel product of the present invention is a single-ply, two component, three-layered sheet. In particular, in one embodiment, the towel product is made of 50% Northern softwood Kraft virgin (NWSK) fibers and 50% southern softwood Kraft virgin (SSWK) fibers. Preferably, the outer layers are comprised of the NSWK fibers and the middle layer is comprised of SSWK fibers in the ratio of 25%//50%//25%. In other words, half of the 50% (i.e., 25%) of the NWSK fibers are in one outer layer, the remaining half of the 50% (i.e., the remaining 25%) of the NWSK fibers are in the other outer layer, and the entire 50% of SSWK fibers are in the middle layer. In another embodiment, the outer layers are comprised of NSWK fibers and the middle layer is comprised of Southern wet lap softwood fibers and Weyerhauser HBA-S curly southern pine fibers in the ratio of 25%//40%//10%//25%. In other words, one outer layer is all NSWK fibers (in the ratio of 25% of the total 100% of the ply), the other outer layer is also all NSWK fibers (in the ratio of 25% of the total 100% of the ply) and the middle layer is 80% Southern wet lap softwood fibers and 20% Weyerhauser HBA-S curly southern pine fibers. The fibers in the middle layer may also be entirely, or partly, chemithermo-mechanical fibers, or dispersed fibers according to Hermans et al. (U.S. Pat. No. 5,348,620 and U.S. Pat. No. 5,501,768).

Generally, the product of the present invention is produced by adding a binder onto each side of a high bulk uncreped through-dried base sheet, and then creping each side of the base sheet. Binder may be "added" by gravure printing, flexo printing, coating, spraying, ink jet, or hot melt applications.

In particular, utilizing the fiber composition described, the base sheet for the product of the present invention is first formed by conventional means and then rush-transferred and through-airdried (and not creped or calendared) according to any of the following patents: U.S. Pat. No. 5,746,887, issued to Wendt et al. (1998) entitled "Method of Making Soft Tissue Products," U.S. Pat. No. 5,616,207 issued to Sudell et al. (1997) entitled "Method for Making Uncreped, Throughdried Towels and Wipers," U.S. Pat. No. 5,593,545, issued to Rugowski et al. (1997) entitled "Method for Making Uncreped Throughdried Tissue Products without an Open Draw," U.S. Pat. No. 5,591,309, issued to Rugowski et al. (1997) entitled "Papermaking Machine for Making Uncreped Throughdried Tissue Sheets," U.S. Pat. No. 5,667,636, issued to Engel et al. (1997) entitled "Method of Making Smooth Uncreped Throughdried Sheets," or U.S. Pat. No. 5,048,589, issued to Cook et al. (1991) entitled "Non-Creped Hand or Wiper Towel," each of which are incorporated herein by reference.

Next, each side of the uncreped through-dried base sheet has binder added to it, and then each side of the base sheet is creped. In particular, for printing of a latex binder, the base sheet is pulled through gravure nip rolls, when the base sheet is printed with a latex binder. In the gravure nip, the sheet is compressed to a caliper of less than 50% of the caliper that it had before being pulled through the gravure nip.

It was found that a towel product produced in this manner from an uncreped base sheet has a much higher bulk at the same net tensile and softness as a sheet produced from a wet-pressed, creped base sheet. Additionally, it was found that a towel product produced in this manner has a much higher wet tensile at the same bulk as a two-ply creped through-airdried product, especially since the two-ply product derives significant bulk from the two-plying operation.

Suitable through-dry fabrics are described by Wendt et al. (U.S. Pat. No. 5,746,887), Chiu et al. (U.S. Pat. No. 5,429,686).

EXAMPLES

The desired properties of the present invention will be described in greater detail in the following examples and tables.

Example 1

In order to further illustrate this invention, an uncreped throughdried sheet was produced, as shown schematically in FIG. 1. More specifically, a three-layered single ply paper product was made of 5.0% pure LL-19 Northern softwood Kraft virgin (NSWK) fibers and of 50% Southern wet lap softwood fibers. In particular, the three-layered sheet was comprised in the following manner: 25% of the NSWK fibers comprised one outer layer, 50% Mobile wet lap pine fibers comprised the middle layer and the remaining 25% of the NSWK fibers comprised the other outer layer. Chemicals were also placed into the layers of the single-ply product. In particular, 25 kg/mton of Arosurf PA-801 debonder (which is an 80% active solids liquid from Witco Corporation, paper Chemicals Division of Janesville, Wis.) was added to the NSWK fibers, while 10 kg/mton of Kymene 557H (which is 12.5% solution from Hercules, Inc. of Wilmington, Del.) was added to the middle layer mixture.

The resulting three-layered sheet was formed on a conventional twin wire former with forming fabrics (2 and 4 in FIG. 1) both being Lindsay 2164 fabrics. The speed of the forming fabrics was 1500 feet per minute (7.62 meters per second). The newly-formed web was then dewatered to a consistency of about 25 to about 30 percent using vacuum suction from below the forming fabrics before being transferred to the to the transfer fabric 6. The transfer fabric 6 was traveling at a speed of 1402 feet per minute (7.12 meters per second) (7% rush transfer). The transfer fabric 6 was an Appleton Mills T-216-3. A vacuum shoe pulling about 10 to about 12 inches (254 to 305 millimeters) of mercury vacuum was used to transfer the web to the transfer fabric 6.

The web was then transferred to a throughdrying fabric 8, which was an Appleton Mills T124-8. The through-drying fabric 8 was traveling at a speed of about 1402 feet per minute (7.12 meters per second). The web was carried over a throughdryer 9, which was a Honeycomb throughdryer, and which was operating at a temperature of about 400 F. (204° C.). The web was dried to final dryness of about 97 to about 98 percent consistency. The dried base sheet was then transported between upper and lower fabrics (11 and 12 in FIG. 1), which were Asten 934 fabrics, to the transfer reel 14 where the base sheet was wound into a roll 15 for subsequent printing and creping.

Figure 2:
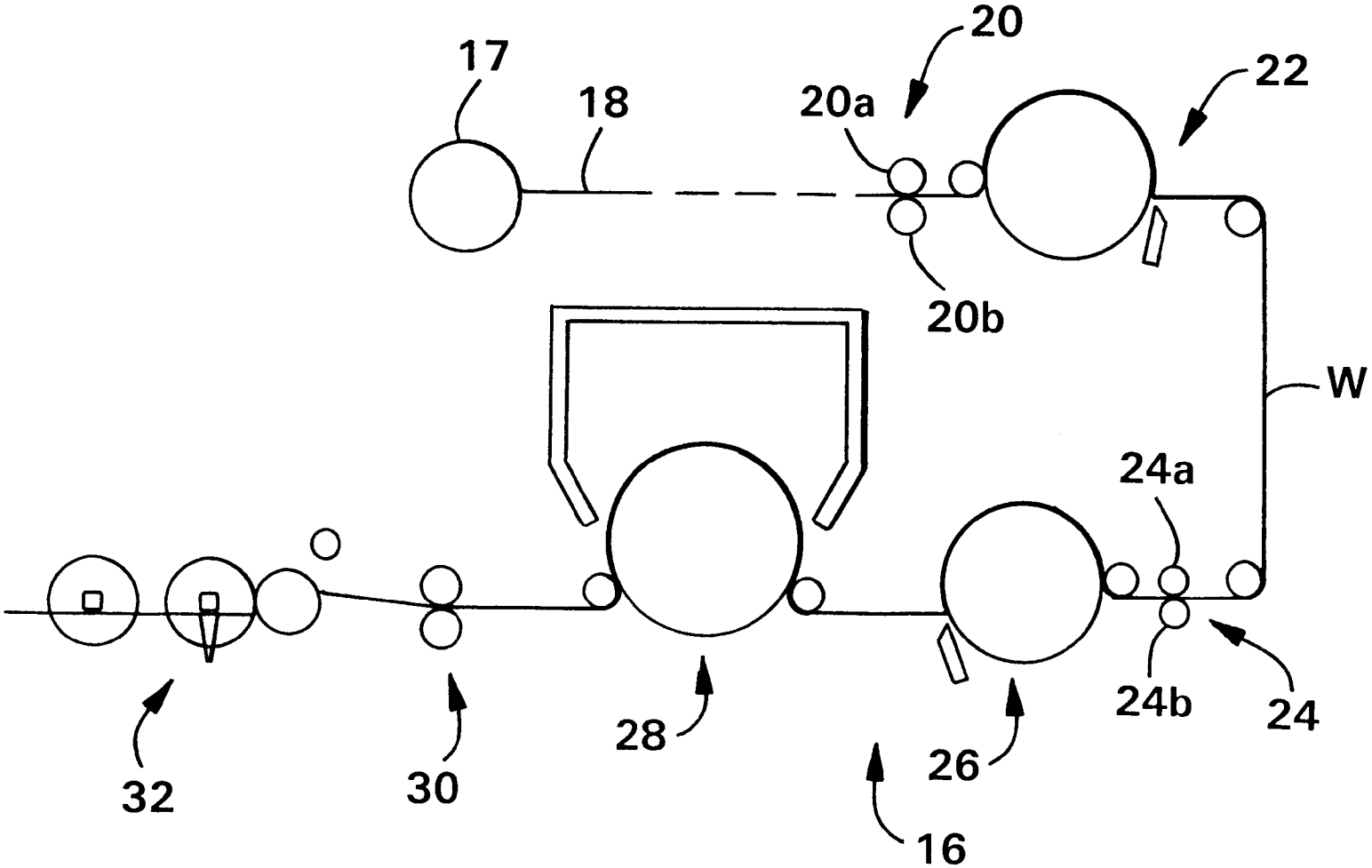
FIG. 2 is a schematic depiction of the printing and creping of the uncreped throughdried base sheet produced in accordance with FIG. 1.

In particular, after being wound into a roll, the base sheet was then transferred to a double recrepe machine or system, as shown in part in FIG. 2. Generally, FIG. 2 illustrates the further steps of printing and creping, successively, the two opposite sides of the uncreped through-dried base sheet produced in accordance with FIG. 1.

In particular, the double recrepe system 16 includes a first printer 20, a first crepe dryer 22, a second printer 24 and a second crepe dryer 26. The system 16 also includes a cure dryer 28, a cool roller pair 30 and a reel 32 for winding the finished paper product into a roll. Preferably, the systems of FIG. 1 and FIG. 2 are combined into one machine, eliminating the steps of winding into a roll (14, 15), transporting the roll, and unwinding it (17).

The print fluids were made with the following formula, added in this order with stirring: Airflex A105 at 52% solids (10,450 grains), NH4Cl at 10% (190 grams), Nalco 7565 anti-foam (20 grams), Natrosol 250 MR powder at 2% (2000 grams) and tap water (6747 grams). The Airflex A 105 is a binder and, more particularly, is a self-cross-linking ethylene-vinyl acetate emulsion from Air Products and Chemicals, Allentown, Pa. The Nalco 7565 anti-foam is a product of Nalco Chemical Company, Naperville, Ill. The Natrosol 250 MR powder is a product of Aqualon, a division of Hercules, Inc., Wilmington, Del. The resultant A105 solids was 28% and the Brookfield viscosity was 490 cp.

Generally, the uncreped through-dried base sheet was printed on one side with a double depth gravure roll, pressed to a dryer, creped, printed on the other side in a second printer, creped, cured in a through-air curing unit, and rolled up. As shown in FIG. 2, the first printing took place at the first printer 20, which is comprised of a gravure nip. In particular, the web 18 was unwound from roll 17 (which is roll 15 in FIG. 1) and traveled through the gravure nip 20, which is comprised of backing roll 20*a* and engraved roll 20*b*. One side of the web 18 (which we will call the first side) was printed in the gravure nip 20 utilizing the print fluids described above. The engraved roll 20*b* had a basketweave pattern, as described in U.S. Pat. No. 5,776,306, issued to Hepford and assigned to Kimberly-Clark Worldwide, Inc., herein incorporated by reference. In alternative embodiments, other double depth patterns may be used, such as, for example, the dot—deep dot patterns of U.S. Pat. No. 3,903,342, issued to Roberts et al. and U.S. Pat. No. 4,000,237, issued to Roberts et al., both herein incorporated by reference.

The web 18 then traveled to the first crepe dryer 22 where the web 18 was pressed and the first side of the web 18 was creped. The web 18 then traveled to the second printer 24, which is also a gravure nip comprised of gravure nip rolls 24*a*, 24*b*. Similar to gravure nip 20, the gravure nip 24 is comprised of a backing roll 24*a* and an engraved roll 24*b*. In the gravure nip 24, the second side of the web 18 was printed, again using the print fluids described above. In gravure nip 24, the second side of the web 18 was printed with a dot pattern. Alternatively, the second side may be printed with a basketweave pattern, or other dot patterns. The web 18 then traveled to the second crepe dryer 26 where the web 18 was pressed and the second side of the web 18 was creped.

As also shown in FIG. 2, the web 18 was then cured in the through-air cure dryer 28 with a 500 F. (260 C.) air supply and then rolled up onto reel 32 at a reel speed of about 200 feet per minute.

Example 2

Example 2 is the same as Example 1 (both as to composition and production), with the following exceptions. First, the middle layer of the single-ply product of Example 2 is a mixture of 80% Mobile wet lap pine fibers and 20% Weyerhaeuser HBA-S curly southern pine fibers (from Weyerhauser, Inc. of Tacoma, Wash.). Second, the amount of the different components of the print fluid for the print-crepe process were slightly different than that of Example 1. In particular, the print fluids were made with the following formula, added in this order with stirring: Airflex A105 at 52% solids (10,450 grams), NH4Cl at 10% (190 grams), Nalco 7565 anti-foam (20 grams), Natrosol 250 MR at 2% (400 grams) and tap water (7053 grams). The resultant A105 solids was 30% and the Brookfield viscosity was 28 cp.

Test Results

The physical properties of the products made as described above were measured and are set forth in TABLE 1 below. For comparison, the properties of some commercially available towels are set forth in TABLE 2. These towels include (1) a towel manufactured using the double recreped process, which is known commercially as VIVA® and sold by the Kimberly-Clark Corporation, (2) a two-ply towel manufactured using an uncreped through-air-dried process, which is known commercially as Super Saugtuch® and sold by the Kimberly-Clark Corporation in France and (3) a towel manufactured using a creped throughdried process, which is known commercially as Bounty® and sold by the Procter & Gamble Company.

As used in TABLES 1 and 2, "Technology" refers to the method by which the product is made: Other terms used in the tables and their meanings are as follows: "Specific Modulus" is the geometric mean slope (kilograms) divided by the geometric tensile strength of the product (grams per 3 inches); "Bulk" is the bulk (cubic centimeters/grams); and "Wet strength ratio" is the cross direction wet tensile strength of the product (grams per 3 inches) divided by the cross direction dry tensile strength of the product (grams per 3 inches) (thus, the wet strength ratio has no dimensions).

TABLE 1

| | (Products of this Invention) | |
|---|---|---|
| Product | Example 1 | Example 2 |
| Technology | Method of this invention | Method of this invention |
| Specific Modulus | 0.0038 | 0.0039 |
| Bulk | 11.05 | 11.97 |
| Wet strength ratio | 0.57 | 0.61 |
| Dry CD Stretch | 15.0% | 18.1% |
| Wet CD Stretch | 14.4% | 16.4% |

TABLE 2

| (Commercially Available Products) | | | |
|---|---|---|---|
| Product | VIVA ® | Super Saughtuch ® | Bounty ® |
| Technology | Double recreped | Uncreped through-airdried | Creped through-airdried |
| Specific Modulus | 0.0042 | 0.010 | 0.0061 |
| Bulk | 9.7 | 19.8 | 13.8 |
| Wet strength Ratio | 0.64 | 0.24 | 0.35 |
| Dry CD Stretch | 14.6 | 6.3 | 9.2 |

These results show that the products of this invention have combinations of higher caliper, lower specific modulus, higher CD stretch and higher wet strength ratio than any of the commercial products of Table 2.

It will be appreciated that the foregoing examples, given for purposes of illustration, are not to be construed as limiting the scope of this invention, which is defined by the following claims and all equivalents thereto.

What is claimed is:

1. A strong, soft and absorbent disposable paper product or paper sheet comprising at least one web of fibers, said at least one web of fibers having a dry, specific modulus less than about 0.0040 kilograms/grams per 3 inches, a bulk of greater than about 10 $cm^3/g$ and a wet strength ratio of greater than 0.40.

2. The strong, soft and absorbent disposable paper product of claim 1 wherein said specific modulus is less than about 0.0038 kilograms/grams per 3 inches.

3. The strong, soft and absorbent disposable paper product of claim 1 wherein said specific modulus is less than about 0.0034 kilograms/grams per 3 inches.

4. The strong, soft and absorbent disposable paper product of claim 1 wherein said bulk is greater than about 11 $cm^3/g$.

5. The strong, soft and absorbent disposable paper product of claim 1 wherein said bulk is greater than about 12 $cm^3/g$.

6. The strong, soft and absorbent disposable paper product of claim 1 wherein said wet strength ratio is greater than about 0.5.

7. The strong, soft and absorbent disposable paper product of claim 1 wherein said wet strength ratio is greater than about 0.6.

8. The strong, soft and absorbent disposable paper product of claim 1 wherein its CD dry stretch is greater than about 15%.

9. The product of claim 1 wherein the wet strength ratio is about 0.5 or greater.

10. The product of claim 1 wherein the wet strength ratio is about 0.6 or greater.

11. A strong, soft and absorbent disposable paper product comprising at least one web of fibers, said at least one web of fibers having a dry, specific modulus less than about 0.0040 kilograms/grams per 3 inches, a bulk of greater than about 10 $cm^3/g$ and a wet strength ratio of from about 0.5 to about 0.6.

12. The paper product of claim 11 wherein the wet strength ratio is from 0.57 to 0.61.

13. A strong, soft and absorbent paper web of fibers having a dry specific modulus less than about 0.0040 kilograms/grams per 3 inches, a bulk of greater than about 10 $cm^3/g$ and a wet strength ratio of from about 0.5 to about 0.6.

14. The web of claim 13 wherein the specific modulus is less than about 0.0038 kilograms/grams per 3 inches.

15. The web of claim 13 wherein the specific modulus is less than about 0.0034 kilograms/grams per 3 inches.

16. The web of claim 13 wherein said bulk is greater than about 12 $cm^3/g$.

17. The web of claim 13 wherein said bulk is greater than about 12 $cm^3/g$.

18. The web of claim 13 wherein the CD dry stretch is greater than about 15%.

* * * * *